US005713616A

United States Patent [19]

Knudson

[11] Patent Number: 5,713,616

[45] Date of Patent: Feb. 3, 1998

[54] COLLECTION SYSTEM AND METHOD

[76] Inventor: Jan B. Knudson, 3836 Souther Heather Dr., Tempe, Ariz. 85282

[21] Appl. No.: 654,310

[22] Filed: May 28, 1996

[51] Int. Cl.[6] ..... A01K 29/00; E01H 1/12

[52] U.S. Cl. ..... 294/1.3; 206/223

[58] Field of Search ..... 294/1.1, 1.3–1.5, 294/55, 146, 159; 206/38, 223, 549, 581; 119/161; 383/33; 150/112, 114; 15/252.1, 257.2, 257.6

[56] References Cited

U.S. PATENT DOCUMENTS

| | | | |
|---|---|---|---|
| 4,019,768 | 4/1977 | Niece . | |
| 4,192,365 | 3/1980 | Siegel | 150/112 |
| 4,226,456 | 10/1980 | Barnett . | |
| 4,341,410 | 7/1982 | Summach | 294/1.3 |
| 4,350,274 | 9/1982 | Morgan . | |
| 4,428,610 | 1/1984 | Guffey | 294/1.3 |
| 4,752,093 | 6/1988 | Haber et al. | 294/1.3 |
| 4,917,238 | 4/1990 | Schumacher . | |
| 5,265,719 | 11/1993 | Wand | 206/223 |
| 5,269,575 | 12/1993 | Parvaresh | 294/1.5 |
| 5,447,227 | 9/1995 | Koseberg | 206/223 |
| 5,511,682 | 4/1996 | Pace | 220/908 |

FOREIGN PATENT DOCUMENTS

| | | |
|---|---|---|
| PCT/IT9200053 | 5/1992 | WIPO . |

*Primary Examiner*—Dean Kramer

*Attorney, Agent, or Firm*—Parsons & Goltry; Robert A. Parsons; Michael W. Goltry

[57] ABSTRACT

A method for collecting excrement left behind by a domestic animal, including the steps of providing a receptacle having a chamber, the excrement being receivable therein and a plurality of tools. Collecting and depositing the excrement into the chamber, and providing a plurality of pockets for carrying the tools in combination with the receptacle.

5 Claims, 4 Drawing Sheets

FIG. 9
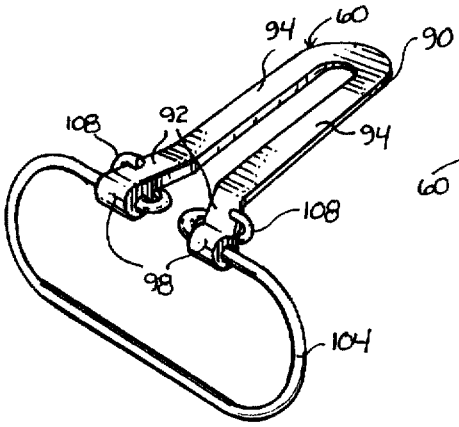
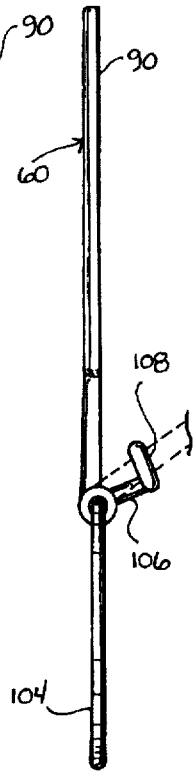
FIG. 10
FIG. 11
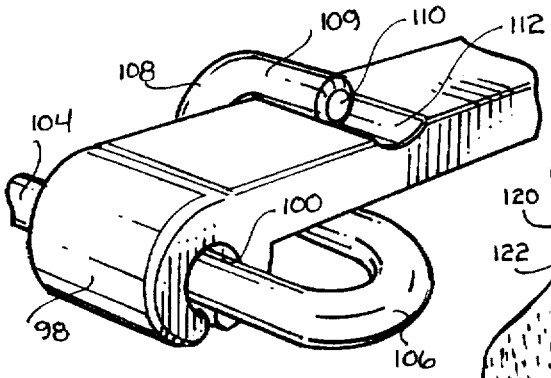
FIG. 12
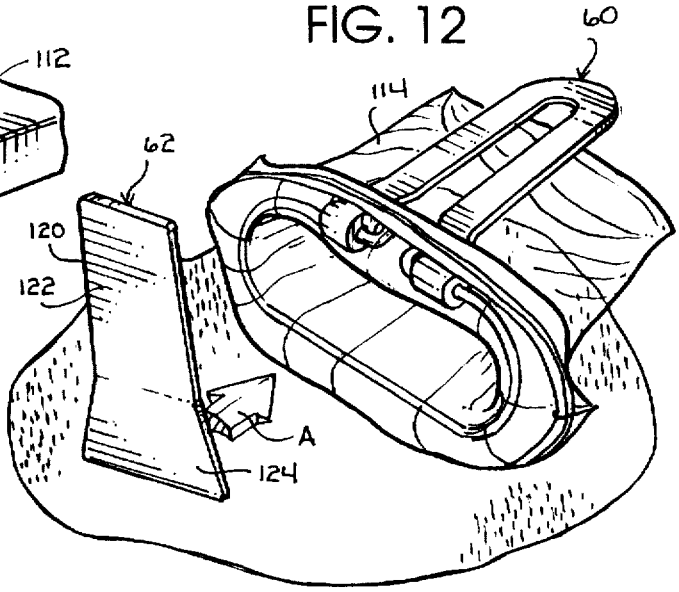
FIG. 13
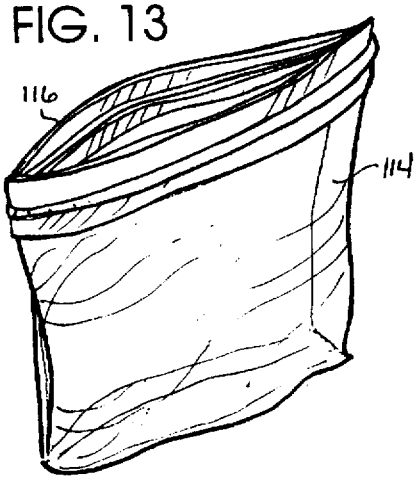
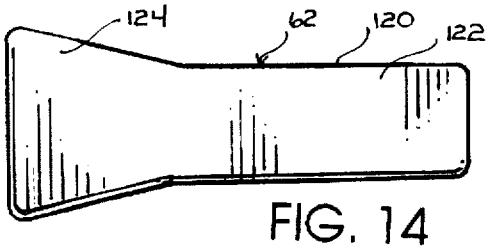
FIG. 14

COLLECTION SYSTEM AND METHOD

BACKGROUND OF THE INVENTION

1. Field of the Invention

This invention relates to collection devices.

More particularly, this invention relates to devices for collecting excrement.

In a further and more specific aspect, the instant invention relates to a collection system for collecting excrement left behind by a domestic animal.

2. Prior Art

The prior art is replete with apparatus for collecting waste, specifically fecal material, left behind from domestic animals. The reason for the wide variety of such apparatus is one of necessity. In particular, the problem of waste or excrement left behind by domestic animals on sidewalks, walkways, parks, common areas, and other areas, is widespread. Many cities and municipalities have enacted laws requiring animal owners to restrain their animals and clean up the excrement that the animals invariably leave behind for preventing others from stepping in it and from inhibiting health risks associated with its presence. However, these laws are seldom observed and difficult and impractical to enforce. Accordingly, the deposition of excrement in public and other urban areas is prevalent, especially the excrement left behind from domestic dogs. Although the prior art has provided an array of apparatus for use in aiding pet owners with the unpleasant task of collecting excrement left behind by their pets, these apparatus are difficult to carry and not easily employed.

For instance, one prior art apparatus includes a container having a lid with an integral scoop. The lid may be detached from the container, excrement scooped up with the scoop, and the lid then placed back on the container with the excrement being deposited therein. The disadvantages inherent with this device is that the user runs the risk of getting excrement on his or her hands when scooping up the excrement, and the scoop and the container are not easily cleaned after use.

Another prior art device incorporates a collapsible frame operative for supporting a bag in an open position. The device further includes an excrement engagement portion operative for engaging the excrement and for conducting the excrement into the bag. Although this device is exemplary, it fails to provide for efficient transport and storage of the excrement once collected. Furthermore, although the engagement portion is a useful feature of this device, it is not suitable for collecting excrement in challenging terrain. For instance, many times, dogs deposit excrement in deep grass, and irregular terrain making it difficult for a user to engage the excrement with the engagement portion in order to collect the excrement. This can be frustrating, and in such an event, many users just leave the excrement without picking it up. Additionally, the instant apparatus is also not easily transported.

Another notable device is comprised of a waste cleanup kit including a box having a plurality of contents for aiding a user in collecting and disposing of excrement. The contents include an absorbent material, a disinfectant and scoop for scooping up the excrement, and a scraper for scraping the excrement from a surface, along with an array of other such tools useful in the collection and disposition of excrement. Although this waste cleanup kit is also exemplary, it is somewhat heavy, difficult to transport, cumbersome to use, and further incorporates gloves, towels, and handwipes that must periodically be replaced at considerable expense relative the cost of the kit.

It would be highly advantageous, therefore, to remedy the foregoing and other deficiencies inherent in the prior art excrement collecting devices.

Accordingly, it is an object of the present invention to provide a new and improved waste collection system.

Another object of the present invention is to provide a waste collection system that is easy to transport.

And another object of the present invention is to provide a waste collection system that is easy to use.

Still another object of the present invention is to provide a waste collection system that is inexpensive to manufacture.

Yet another object of the instant invention is the provision of convenience in the collection and disposal of excrement left behind from a domestic pet.

Yet still another object of the instant invention is to provide a waste collection system that may be used indoors or outdoors.

And a further object of the invention is to provide a waste collection system that encourages pet owners to clean up the waste left behind from their pets.

Still a further object of the immediate invention is to provide a waste collection system that is easily cleaned after use.

Yet a further object of the invention is the provision of a new and improved method of collecting excrement.

And still a further object of the invention is the provision of a waste collection system that is light and easy to carry, while still incorporating a variety of tools operative for aiding the user in the easy and efficient collection and disposal of excrement.

SUMMARY OF THE INVENTION

Briefly, to achieve the desired objects of the instant invention in accordance with a preferred embodiment thereof, provided is a waste collection system for collecting excrement. The system is comprised of a receptacle having a chamber, the excrement being receivable therein. Further included is a plurality of tools for collecting and depositing the excrement, the tools being preferably comprised of a scoop paddle and a collapsible frame for holding a mouth of a bag in an open position for allowing a user to deposit the excrement into the bag with the use of the scoop paddle, the bag then being receivable within the chamber with the excrement residing therein. The receptacle is provided with a plurality of pockets for retaining the tools when not in use, a strap for aiding the user in easy transport, and a plurality of disengagable accesses for aiding a user in cleaning portions thereof when soiled.

Further provided is a method for collecting excrement left behind by a domestic animal. The method includes the steps of providing a receptacle having a chamber, providing a plurality of tools for collecting excrement, and collecting and depositing the excrement into the chamber with the tools. The method further includes the steps of providing the receptacle with a plurality of pockets for carrying the tools when not in use, providing a strap for aiding the user in easy transport of the receptacle, and providing the receptacle with disengagable accesses for aiding a user in cleaning portions thereof when soiled.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 9 is a perspective view of the collapsible frame of FIG. 8;

FIG. 10 is a side elevational view of the collapsible frame of FIG. 8;

FIG. 11 is an enlarged fragmentary perspective view of hinge portion of the collapsible frame of FIG. 8;

FIG. 12 is a perspective view of the collapsible frame of FIG. 8 shown as it would appear in use for holding a mouth of a bag in an open configuration for introducing excrement therein with the use of a scoop paddle;

FIG. 13 is a perspective view of the bag shown in FIG. 12;

FIG. 14 is a top plan view of the scoop paddle of the instant invention.

DETAILED DESCRIPTION OF THE PREFERRED EMBODIMENT

Figure 1:
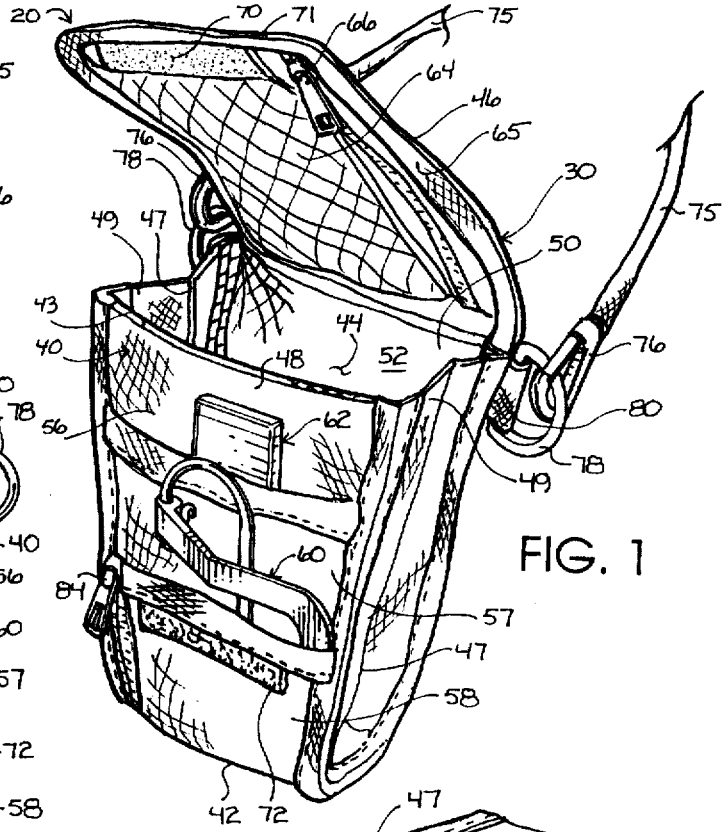
FIG. 1 is a perspective view of a waste collection system for collecting excrement and apparatus constructed in accordance with the preferred embodiment.

Turning now to the drawings, in which like reference characters indicate corresponding elements throughout the several views, attention is first directed to FIG. 1 which illustrates a first embodiment of the instant invention comprising a collection apparatus being generally designated by the reference character 20. Collection apparatus 20 is useful as a collection system for easily and efficiently collecting excrement left behind by a domestic animal. In particular, dog owners are prevalent throughout the world. Throughout any given day, dog owners normally set aside a time for taking their dogs outside for the purpose of allowing them the opportunity to void. Among dog owners, this time is typically referred to as "potty time." Because many dog owners live in urban areas having ordinances requiring them to clean up after their dogs, collection apparatus 20 is easily transported by the user thereby allowing him or her to easily and efficiently collect the excrement of their excrementitious pets. Because excrement, collected in the form of fecal matter, is readily identifiable having distinctive visual and odoriferous attributes, the specific details of such will not be herein specifically addressed.

Figure 2:
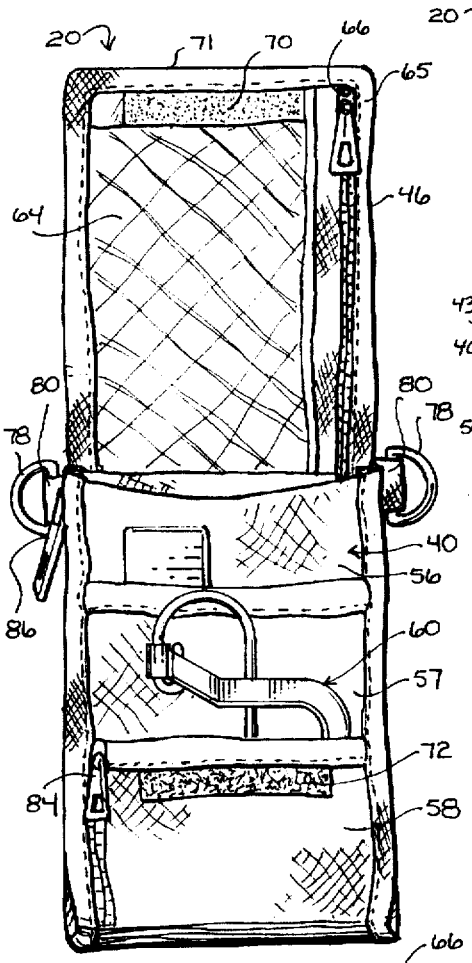
FIG. 2 is a front elevational view of the apparatus shown in FIG. 1.
Figure 3:
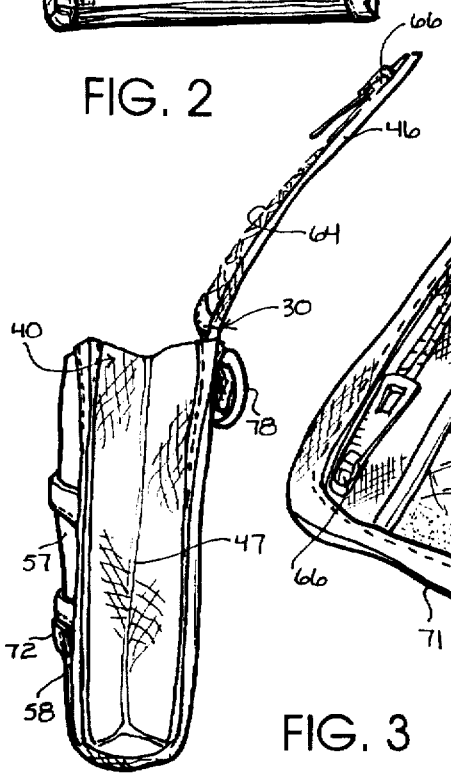
FIG. 3 is a side elevational view of the apparatus shown in FIG. 2.
Figure 4:
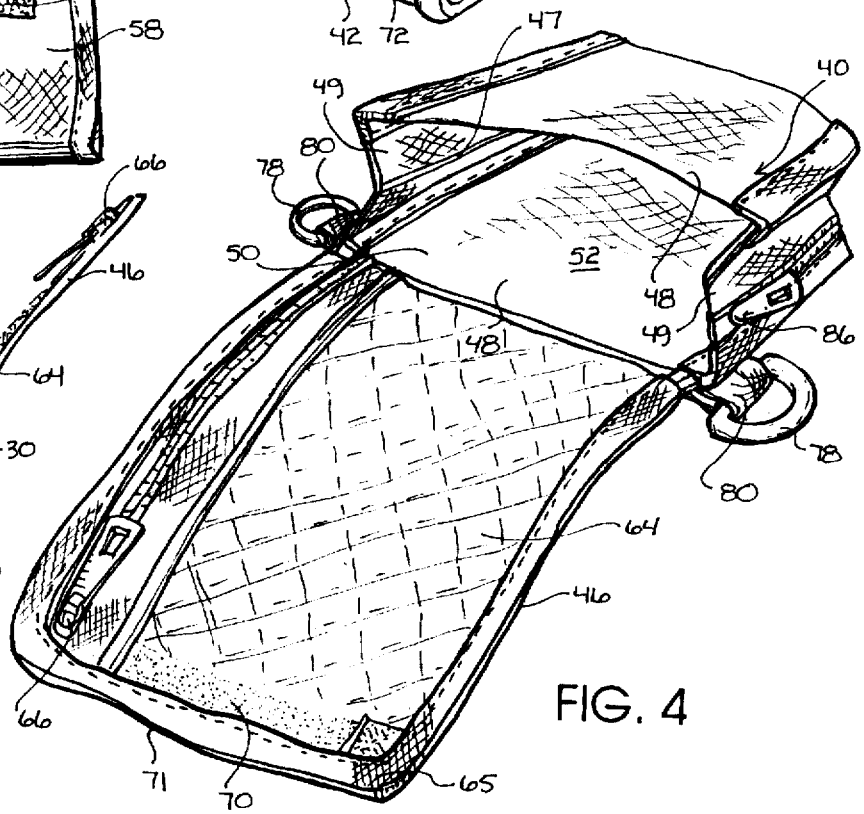
FIG. 4 is a fragmented perspective view of portions of a receptacle of the instant invention showing a flap having a pocket therewith.

With continuing reference to FIG. 1, collection apparatus 20 is comprised of a purse 30. Purse 30, being preferably constructed of a substantially pliant material such as canvas or the like, with the specific elements to be discussed in combination therewith being preferably sewn together by conventional techniques, includes a receptacle defined by a continuous sidewall 40 having a closed end 42, an upper rim 43 defining an open end 44, and a flap 46 secured proximate rim 43, flap 46 being movable between a first position for revealing open end 44, and a second position (not herein specifically shown) for concealing open end 44. Continuous sidewall 40 is generally comprised of two spaced-apart upstanding side panels 48, and two spaced-apart upstanding end panels 49, each end panel 49 having a generally centrally disposed longitudinal pleat 47 for facilitating the selective desirable collapse of purse 30 for easy storage when not in use, of which will be readily appreciated, and of which can be easily seen in FIG. 3. As can be seen in FIG. 1, FIG. 2, and FIG. 4, continuous sidewall 40 further includes a continuous inner surface 50 defining a chamber 52 therein. Further included is a plurality of pockets affixed to a front surface 56 of continuous sidewall 40 of which can further be seen in FIG. 2, the pockets being comprised of an upper pocket 57 and a lower pocket 58. Pockets 57 and 58, being disposed in a generally and respectively layered configuration, function as a retention means for retaining excrement collection means operative for aiding a user in collecting and depositing excrement into chamber 52. With respect to the preferred embodiment, the excrement collection means herein comprise a plurality of tools including a collapsible frame 60 shown carried in lower pocket 58, and a scoop paddle 62 shown carried in upper pocket 57, details of which will be herein discussed as the detailed description ensues.

With continuing reference to FIG. 1, FIG. 2, FIG. 3, and FIG. 4, flap 46 includes a pocket 64 carried proximate an inner surface 65 thereof. Pocket 64 has a conventional zipper 66 that may be selectively opened for accessing pocket 64 for either removing or introducing items therein, or closed for retaining items therein. Furthermore, collection apparatus 20 is provided with an engagement means for detachably engaging flap 46 to portions of purse 30 for securing flap 46 in the second configuration. In particular, flap 46 is provided with an element 70 of an engagement pair disposed proximate a distal end 71 of flap 46, with a complemental element 72 of the engagement pair positioned proximate lower pocket 58, element 70 being detachably engagable with complemental element 72. With respect to the preferred embodiment, the engagement pair is comprised of a typical hook and loop Velcro® fastening mechanism, with element 70 being provided as a hook medium, and complemental element 72 being provided as a loop medium, such mechanism being readily available and well know to those having ordinary skill in the art. When flap 46 is disposed in the second configuration, with element 70 being detachably engaged to complemental element 72, flap 46 not only conceals open end 44, but also is operative for covering pockets 57 and 58 respectively, thereby inhibiting items carried therein from falling out during transport. Although flap 46 is not herein specifically shown disposed in the second configuration, such an operation will be readily appreciated and understood by those having ordinary skill pursuant to the instant discussion.

It will be understood that a highly efficient collection system has been herein described. In particular, collection apparatus 20 functions as a compact waste collection system allowing a user to easily collect excrement and deposit it within chamber 52, and easily transport purse 30 and a variety of excrement collection tools during potty time, or other appropriate time when the chances are high that the user's pet will deposit fecal material requiring immediate clean up. As can be seen in combination with FIG. 1 and FIG. 7, in order to allow a user to easily transport collection apparatus 20, provided is a strap 75 having conventional hook members 76 engagable with D-shaped ring members 78 coupled to portions of purse 30 proximate open upper end 44 by means of loops 80, loops 80 being constructed of canvas or the like. As such, strap 75 may be used for supporting purse 30 over the shoulder of a user providing a user with an easy and convenient means of transport, while allowing a user to easily access purse 30 when needed. Strap 75 may be constructed of any suitable material and may further be provided as adjustable if desired.

Figure 5:
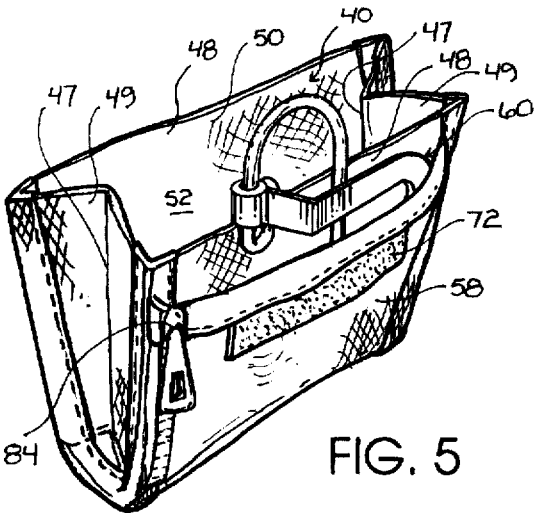
FIG. 5 is a fragmented perspective view of portions of the receptacle of the instant showing a pocket retaining a tool for collecting excrement.

Because the instant invention as herein described is operative for collecting excrement, specifically fecal waste material, left behind by a dog or other domesticated animal, it will be understood that various elements of purse 30 may need to be cleaned from time to time as a result of being soiled with either fecal material, dirt, or other undesirable foreign substances. As a result, and as can be seen in combination with FIG. 1, FIG. 2, and FIG. 5, lower pocket 58 includes an access provided as a conventional zipper 84 that may be selectively unzipped for facilitating access to, and the easy cleaning of, the inside of lower pocket 58. Although not herein specifically shown, it will be readily understood that upper pocket 57 may be provided with just such an access for allowing a user to easily clean it in the event it becomes soiled.

Figure 6:
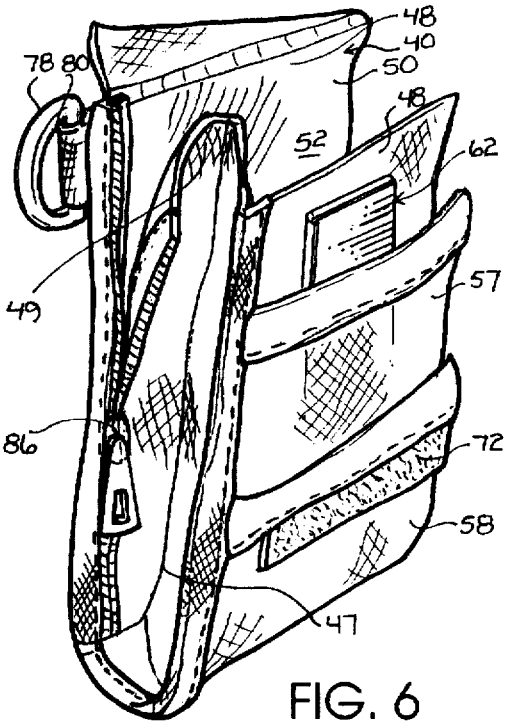
FIG. 6 is a fragmented perspective view of portions of the receptacle of the instant invention somewhat similar to the view of FIG. 5, and further showing a plurality of pockets and a side panel which may be opened for gaining access to a chamber of the receptacle.

Similarly, and as can be seen in combination with FIG. 2, FIG. 4, and FIG. 6, it may become necessary to clean continuous inner surface 50 defining chamber 52. In particular, continuous inner surface 50 may become soiled with fecal material or other foreign substances thus necessitating cleaning. In order to accommodate the ease of accessing chamber 50 for the cleaning thereof, provided is an access comprised of a conventional zipper 86 positioned in a generally horizontal configuration along portions of continuous sidewall 40 proximate one of a selected end panel 49. Zipper 86 may be selectively unzipped with end panel 49 pealed away for facilitating ease of access to chamber 52 for the efficient cleaning thereof. It will be readily understood by those having ordinary skill, that although the conventional zippers herein described for facilitating access to various portions of purse 30 have been herein disclosed consistent with what is believed to be the preferred embodiment. However, other variety of access means operative in combination with purse 30 for facilitating access to portions thereof for easy cleaning may suitably be used in lieu thereof without departing from the nature and scope of the instant invention as herein disclosed.

Figure 7:
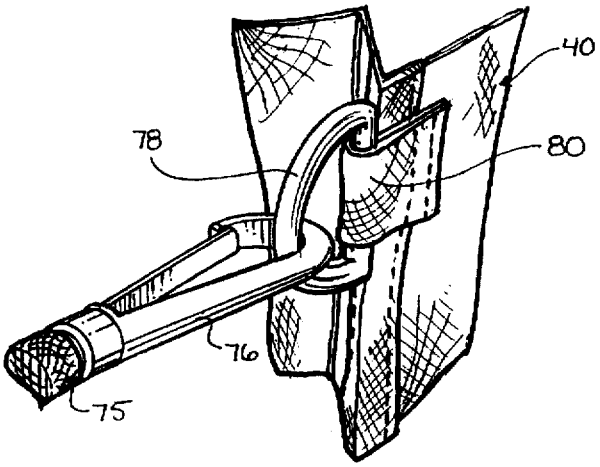
FIG. 7 is an enlarged fragmented perspective view of the end of a strap of the instant invention shown coupled to a ring member coupled to portions of the receptacle.
Figure 8:
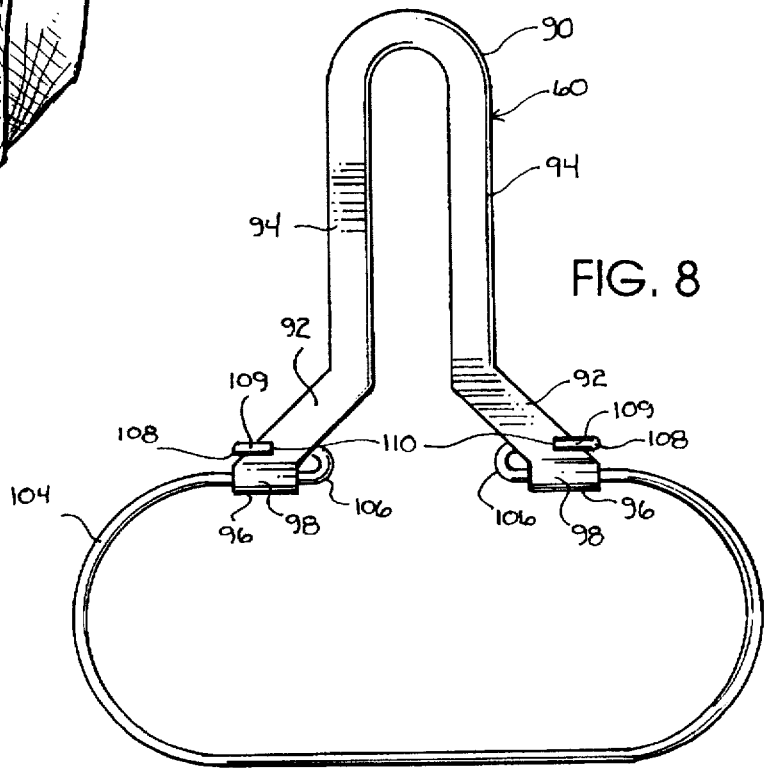
FIG. 8 is a front elevational view of a collapsible frame of the instant invention.

Attention is now directed to FIG. 8–11, which illustrate the various structural and functional characteristics of collapsible frame 60. In particular, as can be seen in FIG. 7, collapsible frame 60, being preferably constructed of a substantially flexible material such as plastic or the like, includes a flexible substantially U-shaped member 90 having outwardly diverging extensions 92 extending respectively from arms 94 of U-shaped member 90, extensions 92 terminating with free ends 96. Free ends 96 are formed as generally cylindrical elements 98 having respective channels 100 which reside along a generally horizontal common axis, one of which can be seen in detail in combination with FIG. 11. Carried within and supported by each channel 100 is provided a substantially elongated and oval support member 104, of which is preferably constructed of plastic or perhaps a type of metal. Portions of support member 104 that extend inwardly from each channel can be seen as including generally U-shaped portions 106 which extend in a substantially rearwardly and outwardly configuration, of which can be appreciated in combination with FIG. 10. Each U-shaped portion 106 terminates with a substantially U-shaped brace 108, each of which is disposed in a generally upwardly and perpendicular plane relative the plane in which U-shaped portions 106 reside, and each of which includes an inwardly extending arm 109 terminating with an inwardly extending free end 110.

In operation, support member 104 of collapsible frame 60 is operative for engaging a mouth of a conventional bag and holding the mouth open for allowing ready reception or introduction of excrement into the bag. The collapsible frame is selectively movable between a first collapsed configuration for easy and compact storage, and a second operative configuration for use in the collection of excrement. With reference to FIG. 9 and FIG. 11, shown is the collapsible frame in the operative configuration. In this configuration, portions of extensions 92 are shown residing within each U-shaped brace 108, with inwardly extending arms 109 residing within and bearing against grooves 112 formed in extensions 92, only one of which is specifically shown as can be seen in FIG. 11, and with inwardly extending arms 109 further bearing against portions of U-shaped portions 106 along the plane in which each U-shape portion resides. In this configuration, support member 104 is fixedly retained in a generally perpendicular position relative U-shaped member 90 so that a conventional bag, such as conventional plastic bag 114 shown in FIG. 12, can be coupled to collapsible frame 60 by engaging the mouth 116 of bag 114 about support member 104 thereby holding the mouth 116 open with the remaining portions of bag 114 extending rearwardly therefrom, a configuration of which can be seen in FIG. 12. As such, collapsible frame 60 may be positioned proximate excrement, with scoop paddle 62 being utilized to engage the excrement and scoop it into bag 114 in the direction indicated by arrow A in FIG. 12. Once the excrement has been manipulated into bag 114, the bag 114 may be removed from collapsible frame 60, the mouth sealed, and bag 114 with the excrement residing therein then stowed within chamber 50 of purse 30 for clean and efficient transport and ultimate future and appropriate disposal.

Due to the flexible nature of U-shaped member 90, arms 94 may be grasp and urged or directed inwardly thereby disengaging extensions 92 from U-shaped braces 108, a configuration of which can be seen in FIG. 10. Once disengaged, support member 104 may be selectively folded against U-shaped member 90 thereby forming the collapsed configuration for easy storage within either pocket 57 or pocket 58, of which can easily be seen in combination with FIG. 5. Furthermore, pocket 64 proximate flap 46 may be selectively used for storing bag 114, or a plurality of selected and desired conventional bags.

With reference to FIG. 12 and FIG. 14, scoop paddle 62, being preferably constructed of plastic or other similar material, is comprised of a generally elongate and substantially planar unitary member 120 having a handle portion 122 and a larger scoop portion 124 for engaging excrement. It will be readily understood that scoop paddle 62, collapsible frame 60, and bag 114, all comprise a plurality of excrement collection tools operative as excrement collection means for collecting and depositing excrement into chamber 52 of purse 30, all of which together function as an efficient and preferred waste collection system. In specific operation, the waste collection system may be easily transported, with the excrement collection tools easily accessed for collecting excrement into bag 114 which may then be selectively deposited within chamber 52 of purse 30 for easy and clean transport thereof for later and proper disposal.

Figure 15:
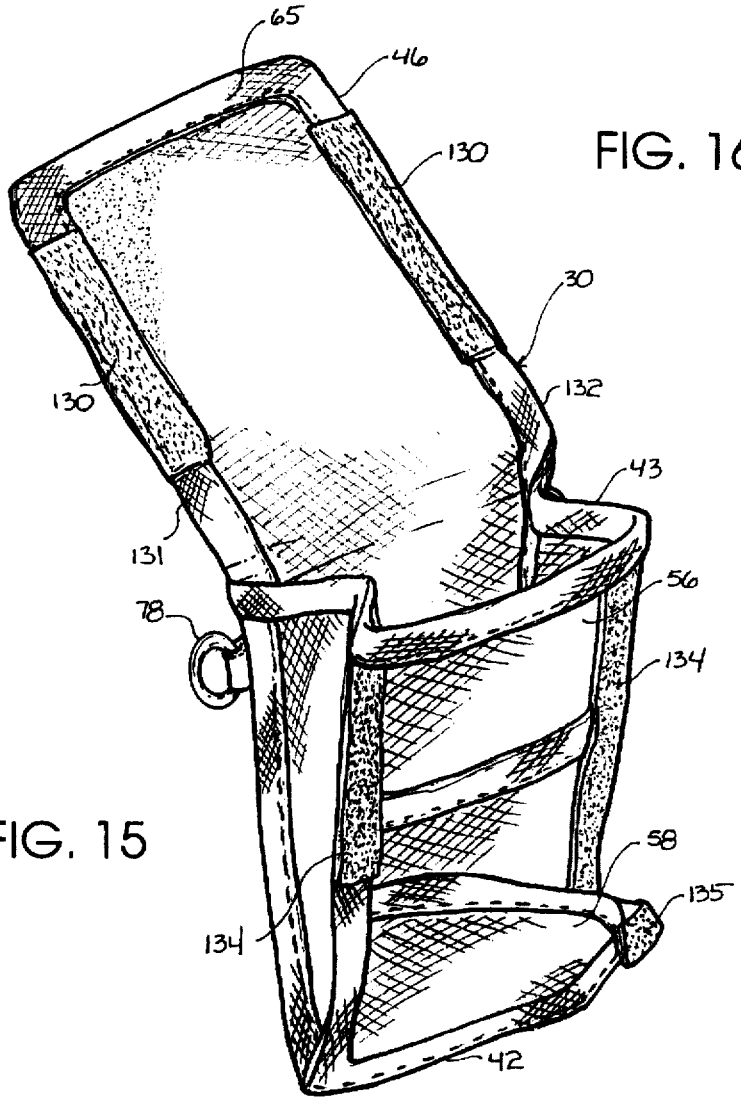
FIG. 15 is perspective view of the purse in accordance with the present invention.
Figure 17:
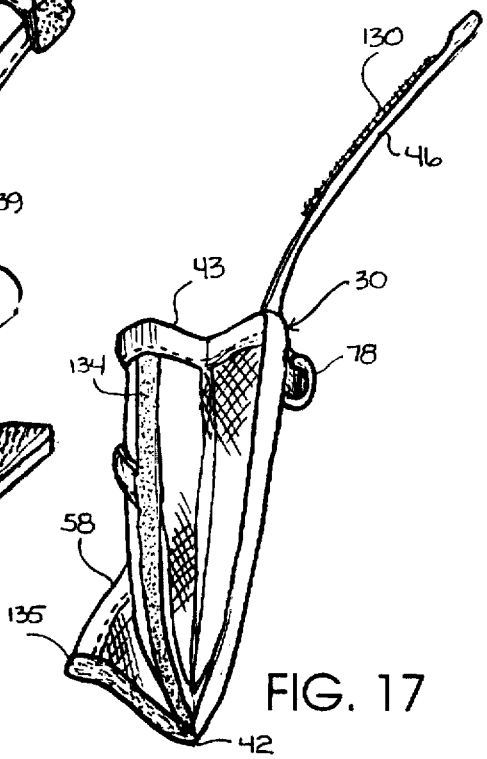
FIG. 17 is a side elevational view of the purse of FIG. 15.

With attention directed to FIG. 15 and FIG. 17, purse 30 can be seen as having a preferred generally tapered configuration. Furthermore, as an alternative engagement means, flap 46 may be provided with an engagement pair comprised of engagement elements 130 disposed upon portions of inner surface 65 proximate side edges 131 and 132 respectively of flap 46, with complimental engagement elements 134 disposed upon portions of front surface 56 of purse 30, elements 130 being detachably engagable with complemental elements 134. With respect to the preferred embodiment, the instant engagement pair is comprised of a typical hook and loop Velcro® fastening mechanism, with elements 130 being provided as a hook medium, and complemental elements 134 being provided as a loop medium, such mechanism being readily available and well know to those having ordinary skill in the art. As will be appreciated, elements 130 and complemental elements 134 are provided in the form of strips having a predetermined width and length, with one of the complemental elements shown traversing substantially the entire length between closed end 42 and upper rim 43 defining open end 44. Similarly, lower pocket 58 may include an access provided as a hook medium 135 of a Velcro® fastening mechanism that may be selectively engaged and disengaged with one of the complemental engagement elements 134 discussed previously for facilitating access to, and the easy cleaning of, the inside of lower pocket 58. Although not herein specifically shown, it will be readily understood that upper pocket 57 may be provided with just such an access for allowing a user to easily clean it in the event it becomes soiled.

Figure 16:
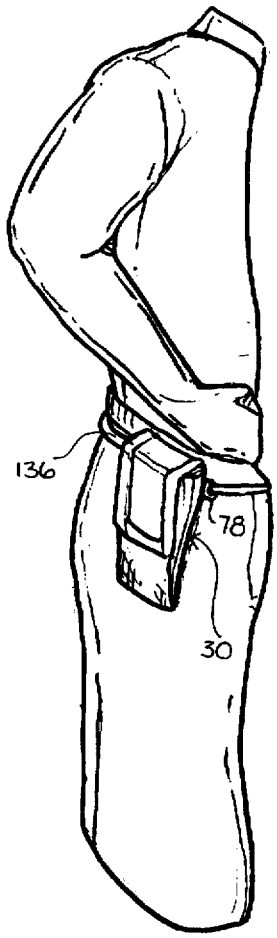
FIG. 16 is a perspective view of the apparatus carried on the belt of a user.
Figure 18:
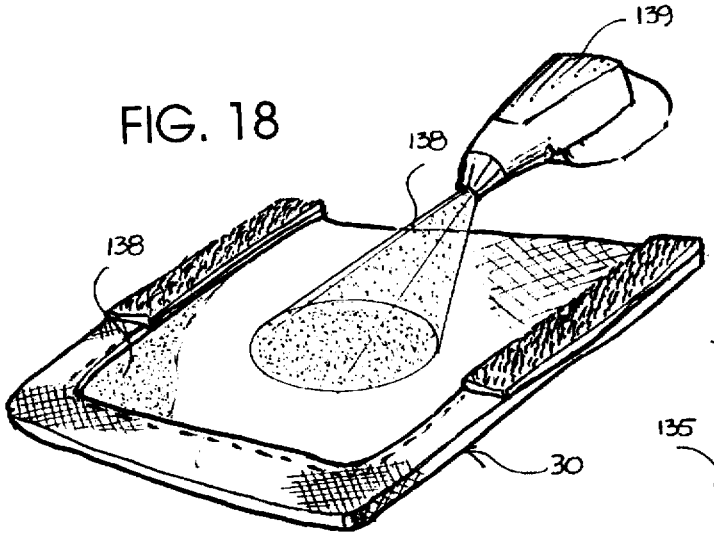
FIG. 18 is fragmentary view of the purse and a spray gun, illustrating application of a waterproof material to the purse.

As can be seen in FIG. 16, purse 30 may suitably be carried about the waste of a user with a belt 136 being looped through ring members 78 and then wrapped around the waste of the user. When carried in this fashion, purse 30 hangs flat against the user for easy transport. Furthermore, as can be seen in FIG. 18, the various elements of purse 30 may be provided with a coating of a conventional waterproof material 138, such as that being applied with the use of a spray gun 139, for allowing easily cleanup of purse 30, and for inhibiting excrement from staining or otherwise penetrating those portions of purse 30 the excrement contacts.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

I claim:

1. A method for collecting excrement left behind by a domestic animal, said method comprising the steps of:

providing a receptacle having a chamber, said excrement being receivable therein, and having a continuous sidewall having a closed end, an open end for accessing said chamber, and a front surface;

providing a plurality of tools;

collecting and depositing said excrement into said chamber with said tools; and providing retention means for retaining said tools with said receptacle when not in use carried on said front surface.

2. The method of claim 1, wherein said step of providing retention means further includes the step of providing a plurality of layered pockets.

3. The method of claim 1, further including the step of providing a flap selectively movable between a first position for substantially concealing said open end, and a second position for revealing said open end for facilitating access to said chamber.

4. The method of claim 3, wherein said step of providing retention means further includes the step of providing said flap with a pocket.

5. A method for collecting excrement left behind by a domestic animal, said method comprising the steps of:

providing a receptacle having a chamber, said excrement being receivable therein;

providing a plurality of tools including:

a scoop paddle for picking up said excrement;

a bag of a conventional type; and a collapsible frame for supporting said bag in an open position thereon for allowing a user to insert said excrement into said bag with said scoop paddle;

collecting and depositing said excrement into said chamber with said tools; and providing retention means for retaining said tools with said receptacle when not in use.

* * * * *